US006496590B2

(12) United States Patent
Proni

(10) Patent No.: US 6,496,590 B2
(45) Date of Patent: Dec. 17, 2002

(54) LOUDSPEAKER WITH IMPROVED DIAPHRAGM

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 171 days.

(21) Appl. No.: 09/733,174

(22) Filed: Dec. 8, 2000

(65) Prior Publication Data

US 2002/0071592 A1 Jun. 13, 2002

(51) Int. Cl.[7] ..... H04R 1/00
(52) U.S. Cl. ..... 381/423; 381/424
(58) Field of Search ..... 381/423, 424, 381/433, 412, 417, 418, 186, 184, 185, 403, 405; 181/163, 164

(56) References Cited

U.S. PATENT DOCUMENTS

| | | | | | |
|---|---|---|---|---|---|
| 2,034,882 | A | | 3/1936 | Scribner | 181/32 |
| 2,071,828 | A | | 2/1937 | Glen | 181/31 |
| 2,269,284 | A | | 1/1942 | Olson | 179/115.5 |
| 2,773,942 | A | | 12/1956 | Christensen | 179/110 |
| 2,775,653 | A | | 12/1956 | Wurdel | 179/115 |
| 3,111,187 | A | | 11/1963 | Barlow | 181/32 |
| 3,573,396 | A | * | 4/1971 | Schoengold | 379/386 |
| 4,132,872 | A | * | 1/1979 | Inoue | 381/423 |
| 4,275,278 | A | | 6/1981 | Sakurai et al. | 179/181 F |
| 4,399,334 | A | | 8/1983 | Kakiuchi et al. | 179/180 |
| 4,414,436 | A | * | 11/1983 | Sashida et al. | 381/424 |
| 4,567,327 | A | | 1/1986 | Goossens et al. | 179/115.5 R |
| 4,628,155 | A | * | 12/1986 | Robineau et al. | 381/387 |
| 4,764,968 | A | | 8/1988 | Kreitmeier | 381/204 |
| 5,033,093 | A | | 7/1991 | Tardo | 381/177 |
| 5,040,221 | A | * | 8/1991 | Edwards et al. | 381/387 |
| 5,734,132 | A | | 3/1998 | Proni | 181/171 |
| 6,236,733 | B1 | * | 5/2001 | Kato et al. | 381/423 |
| 6,330,340 | B1 | * | 12/2001 | Proni | 381/397 |

* cited by examiner

*Primary Examiner*—Rexford Barnie
(74) *Attorney, Agent, or Firm*—Holland & Knight LLP

(57) ABSTRACT

A loudspeaker comprises a motor structure including a voice coil with a hollow former, a frame having an upper end and a lower end connected to the motor structure, an upper suspension mounted to the upper end of the frame, and, a two part diaphragm structure which includes an upper diaphragm connected to the upper suspension and a lower diaphragm extending between the upper suspension and the voice coil in position to overlie the hollow former of the voice coil.

15 Claims, 3 Drawing Sheets

LOUDSPEAKER WITH IMPROVED DIAPHRAGM

FIELD OF THE INVENTION

This invention relates to loudspeakers, and, more particularly, to a loudspeaker having an upper diaphragm and a lower diaphragm which provide extended and substantially improved range of motion in response to movement of the voice coil without bending, buckling, twisting or other deformation which can create acoustic distortion.

BACKGROUND OF THE INVENTION

Loudspeakers generally comprise a frame, a motor structure, a diaphragm, an upper suspension or surround and a lower suspension or spider. In one common type of speaker, the motor structure includes a permanent magnet mounted between a top plate and a back plate, a pole piece centrally mounted on the back plate and a voice coil axially movable with respect to the pole piece. The voice coil includes a hollow, cylindrical-shaped former having an outer surface which receives a winding of wire.

One end of the diaphragm is connected to the surround, which, in turn, is mounted to the upper end of the frame. The spider is connected at one end to a seat formed in the frame at a point between its upper and lower ends. The free ends of the diaphragm and spider are mounted to the voice coil so that it is supported within the magnetic gap between the pole piece and top plate of the motor structure, with the former of the voice coil being concentrically disposed about the pole piece. In some speaker designs, a dust cap is mounted to the diaphragm in position to overlie the voice coil and pole piece to protect them from contaminants.

In the course of operation of a speaker of the type described above, electrical energy is supplied to the voice coil causing it to axially move relative to the pole piece and within the magnetic gap formed between the top plate and pole piece. The diaphragm, spider and surround move with the excursion of the voice coil. Conventionally, the diaphragm is formed in the shape of a cone with an opening cut at its apex in order to mount to the outer surface of the former of the voice coil. The diaphragm extends radially outwardly at an angle from the voice coil to the surround where it is typically connected by adhesive or otherwise permanently affixed. The driving force of the voice coil is applied at approximately the center of the diaphragm, and the diameter of the voice coil is typically much smaller than that of the diaphragm. As a result, there is a wide span along the wall of the diaphragm between the voice coil and surround which is unsupported and subject to deformation.

Deformation of the diaphragm can result from a number of factors, some involving the operation of the speaker and others related to speaker construction. In most applications, the speaker is contained within a cabinet or box which is substantially enclosed to provide protection for the speaker. At low frequencies and high axial excursions of the voice coil, the piston-like movement of the voice coil, diaphragm and spider pressurizes the air within the interior of the speaker box. In one direction of movement of the voice coil, spider and diaphragm, the air within the box is compressed thus tending to push the diaphragm in the opposite direction. Movement of the diaphragm in the reverse direction causes the air within the box to exert a pulling force on the diaphragm. These push and pull forces exerted on the diaphragm can lead to bending or buckling of its wall, creating acoustic distortion. Further, at or near the limits of axial movement of the voice coil and diaphragm permitted by the upper and lower suspensions, such as when the speaker is operated at very high output levels, substantial forces are applied to the diaphragm at its attach points to the voice coil and to the surround, thus causing an increase in bending forces applied to the diaphragm and creating another source of acoustic distortion.

Additionally, as the driving force exerted on the diaphragm by the voice coil increases in frequency, there is a tendency of the outer edge of the diaphragm located at the surround to lag behind its inner edge connected to the voice coil. This "lag" is due to the mass of the diaphragm and the natural compliance of the material from which it is constructed. Past a certain frequency threshold, depending upon the stiffness of the diaphragm material, the wall of the diaphragm no longer moves as a single unit thus creating undesirable acoustic peaks and valleys in the reproduced sound field.

Conventional diaphragms are also susceptible to twisting during operating of the speaker, which is yet another source of acoustic distortion. During assembly, the circular-shaped surround may not be correctly centered on the frame causing one side or area of the surround to be somewhat stretched or extended, while another area is compressed to some extent. In response to movement of the voice coil in one direction, the area of the surround which was stretched to some extent during assembly reaches its limit of extension before the area which was compressed. Conversely, a movement of the voice coil in the opposite direction causes the area which was initially compressed to reach its compression limit before the area which was initially stretched. Consequently, the surround tends to tilt or twist with the movement of the voice coil, which, in turn, causes the diaphragm and voice coil to twist in the same fashion. Such twisting forces imposed on the diaphragm are another source of potential acoustic distortion.

Attempts have been made to reinforce the diaphragm of conventional loudspeakers and provide resistance to bending and twisting forces. One approach has involved the use of two diaphragms, including one outer diaphragm connected to the surround, and at least one second, inner diaphragm connected to the voice coil and to the outer diaphragm. See, for example, U.S. Pat. No. 4,764,968 to Dreitmeier; U.S. Pat. No. 4,275,278 to Sakurai et al; and U.S. Pat. No. 4,567,327 and 4,517,416 both to Goossens.

Despite the use of a second diaphragm for reinforcement of the primary, sound producing diaphragm, the designs in the prior art noted above suffer from common limitations. In each case, the inner diaphragm of such designs is formed with an opening at its center to receive and mount to the former of the voice coil. Particularly in high excursion speakers, the former of the voice coil must be relatively long and therefore it is commonly made from lightweight material to reduce mass. This tends to make the voice coil flimsy in the area where the inner diaphragm is connected. The combination of the opening at the center of the inner diaphragm, and its connection to the relatively weak or flimsy voice coil former, substantially reduces the degree of stiffness which can be provided by the inner diaphragm to the outer diaphragm.

Another limitation of prior two diaphragm designs is that no attempt is made to seal the space in between the inner and outer diaphragms in the area above the voice coil, or, in some instances, anywhere between the two diaphragms. The absence of a seal between the diaphragms results in the alternating pressurization and depressurization of the air in the space between the two diaphragms, which tends to collapse or pull apart the diaphragms depending on the direction of movement of the voice coil. This increases the chance of bending or other deformation of the diaphragms, leading to unwanted distortion.

SUMMARY OF THE INVENTION

It is therefore among the objectives of this invention to provide a loudspeaker which provides improved acoustic performance, particularly at low frequency and high excursions, which limits bending and twisting of the diaphragm and which resists forces imposed by pressurization of the enclosure within which the loudspeaker is mounted.

These objectives are accomplished in a loudspeaker comprising a motor structure including a voice coil with a hollow former, a frame having an upper end and a lower end connected to the motor structure, an upper suspension mounted to the upper end of the frame, and, a two part diaphragm structure which includes an upper diaphragm connected to the upper suspension and a lower diaphragm extending between the upper suspension and the voice coil in position to overlie the hollow former of the voice coil.

In the presently preferred embodiment, the lower diaphragm is a formed in a one-piece construction which extends continuously from the upper suspension to a position overlying the voice coil. No opening or hole is formed in the lower diaphragm to mount it to the former of the voice coil, as in the prior designs described above, but instead the lower diaphragm is integrally formed with a protrusion which either mounts directly to the exterior surface of the former of the voice coil or to a sleeve connected to the voice coil. In either case, the stiffness of the lower diaphragm is enhanced without the formation of an opening therein, which substantially increases the overall stiffness of the inner and outer diaphragm construction compared to the prior art. This is particularly true for high excursion loudspeakers in which the former is comparatively long to accommodate such excursions and therefore must be formed of a lightweight and relatively flimsy material to decrease mass. The continuous lower diaphragm adds stiffness to the former, and, hence, the entire moving assembly of the speaker, which is not achieved by the connection between the former and a lower diaphragm having a hole in the center as in other designs.

In the embodiment of this invention employing the sleeve noted above, the outer diaphragm includes an outer section connected to the outer suspension, and an inner section having a cross section in the shape of a truncated cone with a generally planar top wall and a tapered side wall. The protrusion is formed at the juncture of the tapered side wall of the inner section and the outer section of the lower diaphragm. Preferably, the top wall of the inner diaphragm is mounted to the upper diaphragm by adhesive or the like, which further enhances the overall stiffness and rigidity of the combined upper and lower diaphragm structure. The protrusion of the lower diaphragm is affixed within a trough or well formed at the upper end of the sleeve during the assembly process.

Alternatively, the sleeve is eliminated as noted above, and the lower diaphragm is mounted directly to the former of the voice coil. In this embodiment, the lower diaphragm has an outer section mounted to the upper suspension, and an inner section having a generally semi-circular cross sectional shape positioned to overlie the hollow interior of the former. The protrusion is formed at the juncture of the inner and outer sections of the lower diaphragm, which includes a generally vertically extending wall shaped to rest against the outer surface of the former of the voice coil where it is mounted by adhesive or the like.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
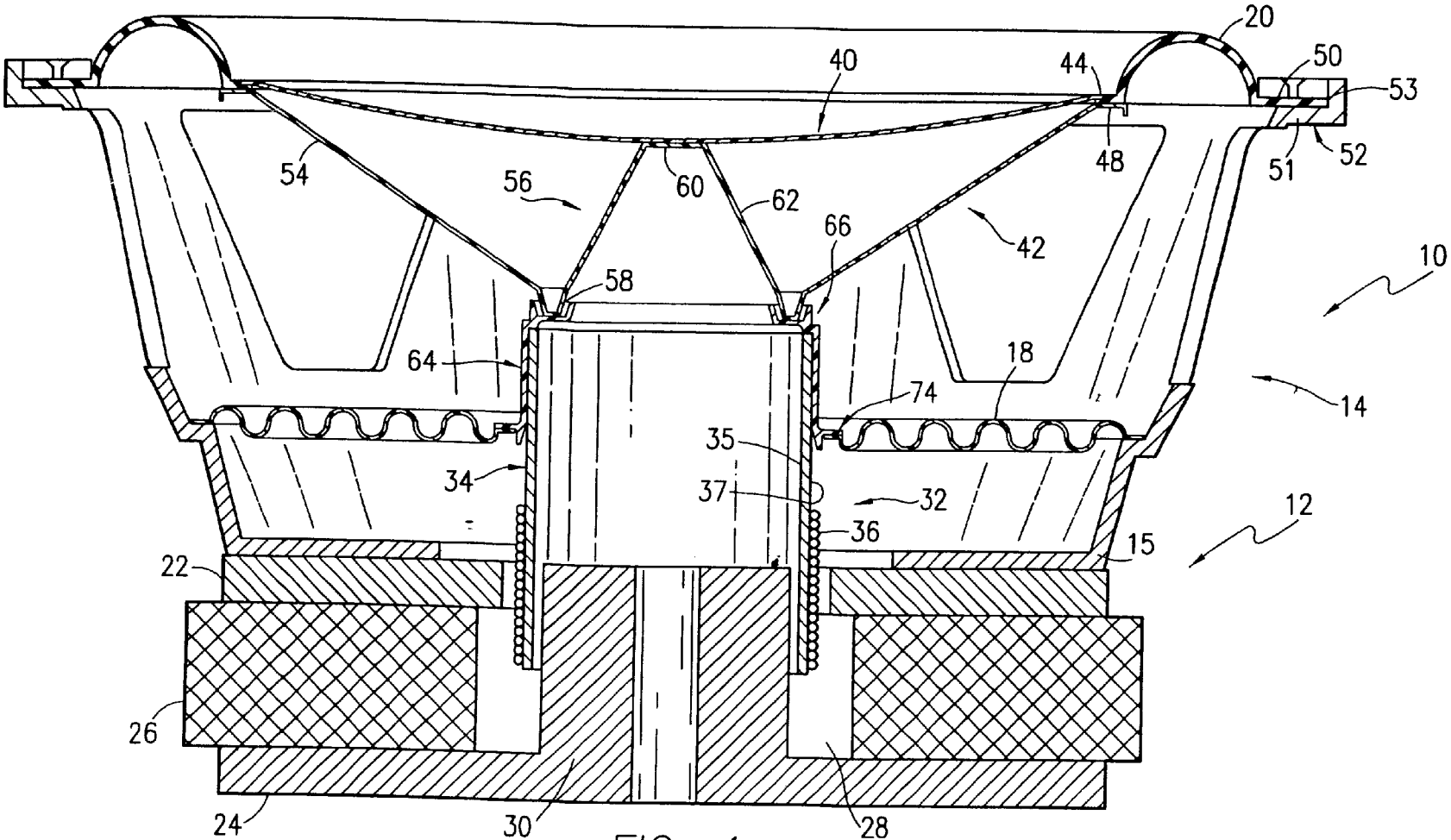
FIG. 1 is an elevational view, in partial cross section, of a speaker having one embodiment of the upper and lower diaphragm construction of this invention.
Figure 3:
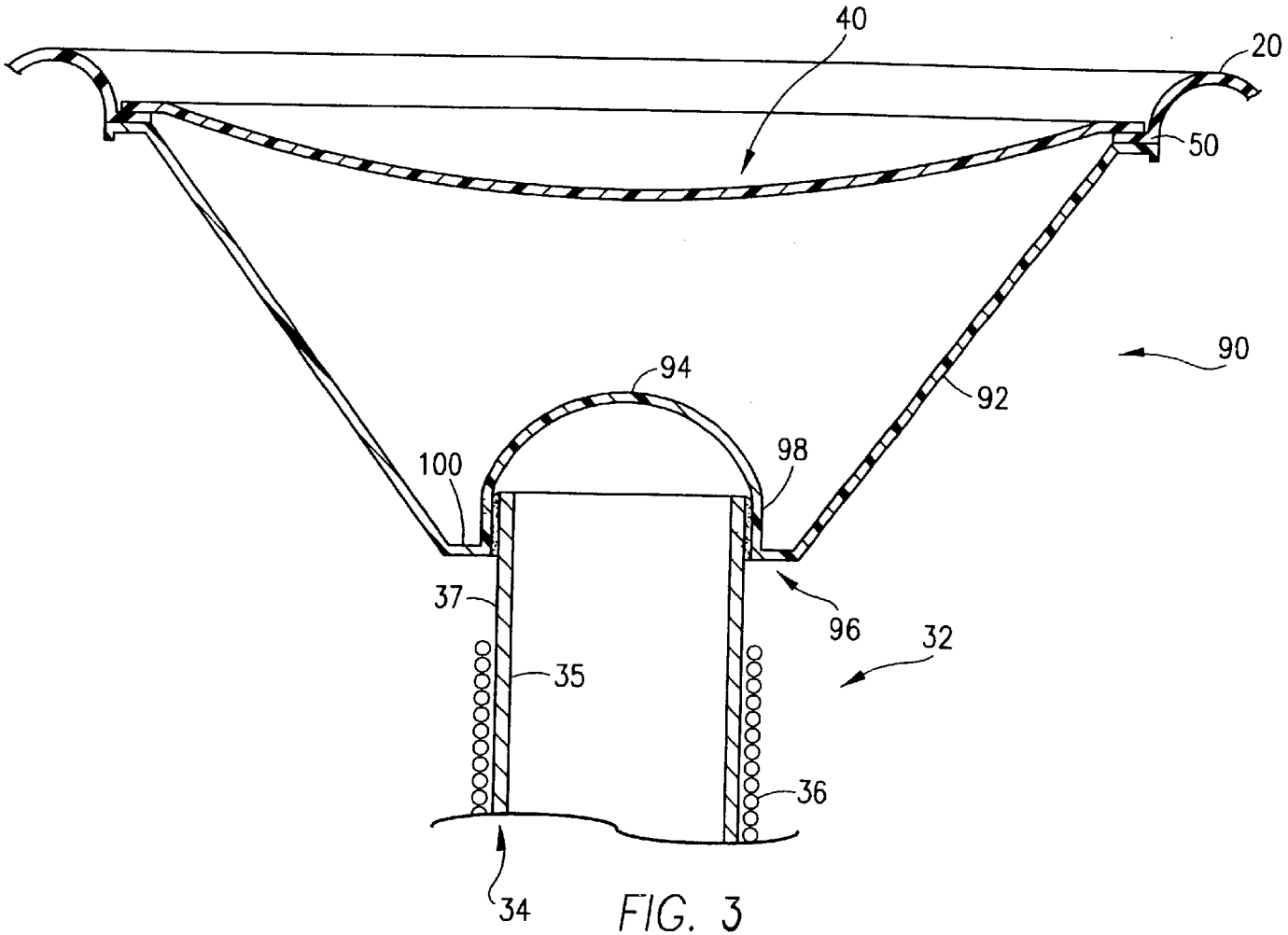
FIG. 3 is a partial view of a loudspeaker as depicted in FIG. 1, except of an alternative embodiment of an upper and lower diaphragm structure in accordance with this invention.

Referring now to FIGS. 1 and 3, a loudspeaker 10 is illustrated which is identical in each embodiment except for the inclusion of a different diaphragm construction as described in detail below. Although the detailed construction of the speaker 10 forms no part of this invention, for purposes of the present discussion it is briefly described as follows.

The elements of speaker 10 common to the embodiments of FIGS. 1 and 3 include a motor structure 12, a frame 14 mounted to the motor structure 12, a lower suspension or spider 18 and an upper suspension or surround 20. Conventionally, the motor structure 12 includes a top plate 22 and a back plate 24 which are spaced from one another and mount a permanent magnet 26 therebetween. A vented pole piece 30 is integrally formed with and extends upwardly from the back plate 24 into a central bore 28 formed in both the magnet 26 and top plate 22. A magnetic gap is formed between the top plate 22 and the pole piece 30, as shown. A voice coil 32 is also provided which includes a hollow, cylindrical-shaped former 34 having an inner surface 35 and an outer surface 37 which receives a wire winding 36. The former 34 is concentrically disposed about the pole piece 30, and the voice coil 32 is axially movable within the magnetic gap during operation of the speaker 10.

For purposes of the present discussion, the terms "top" or "upper" refer to a location or direction toward the uppermost part of the loudspeaker 10 in the orientation as it is depicted in the FIGS., whereas the terms "bottom" or "lower" refer to the opposite direction. Additionally, the terms "inner" or "inwardly" refer to a direction toward the center of the loudspeaker 10 as shown in the drawings, while the terms "outer" or "outwardly" refer to a direction radially outwardly from the center of the loudspeaker 10.

Figure 2:
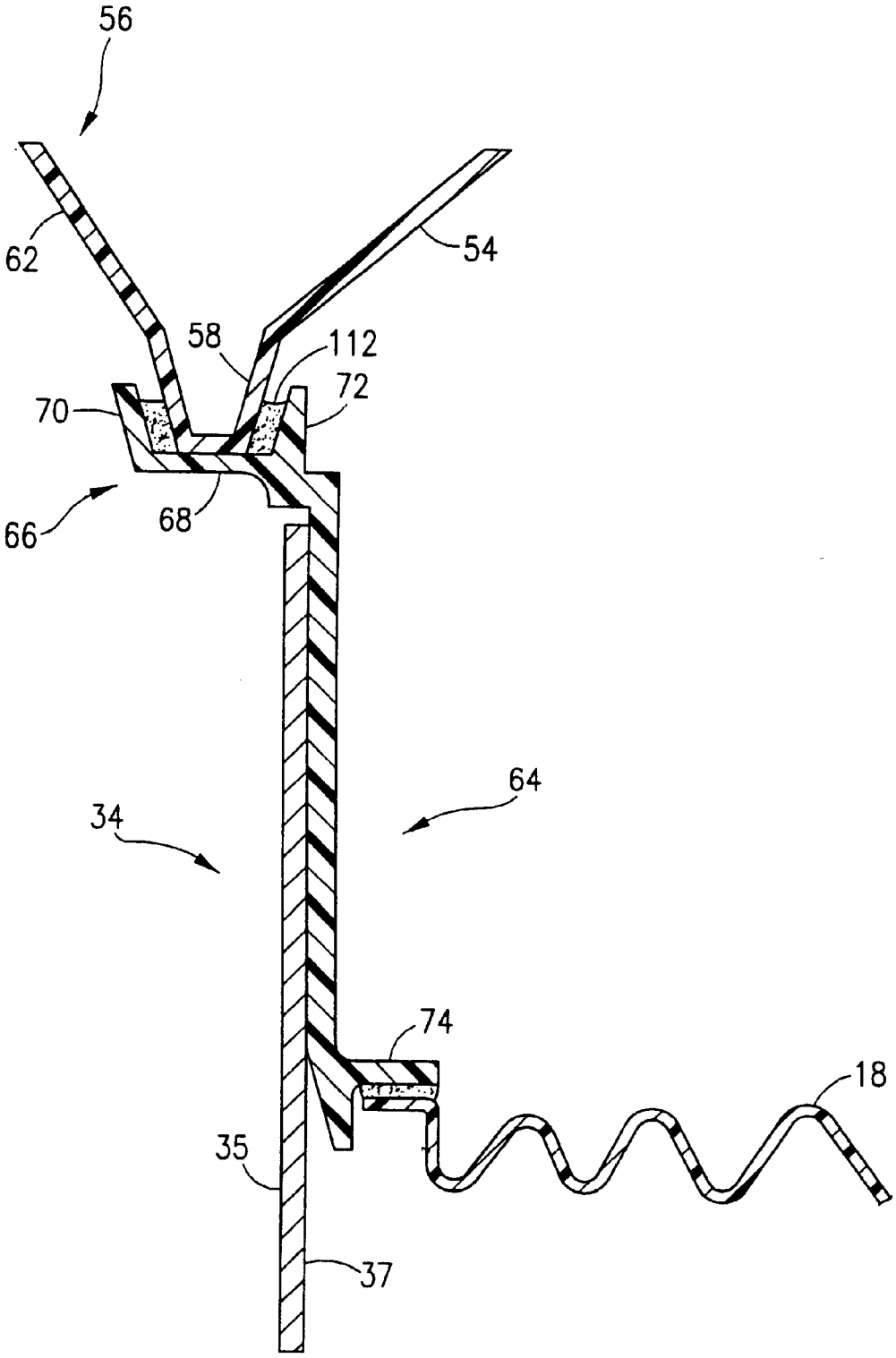
FIG. 2 is an enlarged view of the connection between the lower diaphragm, lower suspension and the voice coil depicted in FIG. 1.

With reference initially to FIGS. 1 and 2, in one presently preferred embodiment, the voice coil 32 is held in place with respect to the pole piece 30 by the spider 18, the surround 20 and a two piece diaphragm construction which includes a upper diaphragm 40 and a lower diaphragm 42. The upper diaphragm 40 is generally circular in shape, and slightly tapered or arcuate in cross section from its outer edge 44 toward the center thereof The outer edge 44 of the upper diaphragm 40 is mounted by adhesive to the upper surface of the inner edge 48 of the surround 20. The opposite, outer edge 50 of the surround 20 is connected to the upper end 52 of the frame 14.

The lower diaphragm 42 is in the general shape of a "W" in cross section, including a tapered outer section 54 integrally formed with an inner section 56. The outer section 54 of the lower diaphragm 42 is connected at one end by adhesive to the lower surface of the inner edge 48 of the surround 20, and it tapers inwardly to form a protrusion 58 at the juncture with the inner section 56. As depicted in FIGS. 1 and 2, the inner section 56 of the lower diaphragm 42 has a substantially frusto-conical cross section defined by a generally planar top wall 60 and a tapered side wall 62. The tapered side wall 62 of the inner section 56 meets with the outer section 54 to form protrusion 58, and the top wall 60 of the inner section 56 is affixed by adhesive to the underside of the upper diaphragm 40.

The lower diaphragm 42 is mounted to the voice coil 32 by a sleeve 64 in position so that the inner section 56 of the lower diaphragm 42 overlies the hollow former 34 of the voice coil 32. In the presently preferred embodiment, the sleeve 64 is essentially a cylindrical-shaped member, formed of light weight but relatively stiff plastic or the like, which is mounted by adhesive to the outer surface 37 of the former 34. The upper end of the sleeve 64 includes an annular trough or well 66 having a bottom wall 68 and opposed side walls 70 and 72. The lower end of the sleeve 64 is formed with a generally horizontally extending platform 74. The spider 18 is adhesively mounted between a seat 15 formed in the frame 14 and the platform 74 at the lower end of sleeve 64. The protrusion 58 formed at the juncture of the outer section 54 and inner section 56 of the lower diaphragm 42 is received within and adhesively mounted to the well 66 at the top of the sleeve 64.

The mounting arrangement described above allows the inner diaphragm 42 to extend continuously, in an uninterrupted one-piece construction, from the surround 20 to a position overlying the voice coil 32 without the formation of an opening or hole in the lower diaphragm 42. The stiffness of the overall diaphragm construction is further enhanced by the connection between the inner section 56 of the lower diaphragm 42 and the upper diaphragm 40. As a result, substantial resistance is provided to bending, buckling and twisting forces imposed during low frequency and high excursion operation of the loudspeaker 10.

With reference to FIG. 3, an alternative embodiment of this invention is shown which includes a two piece diaphragm construction having the same outer diaphragm 40 employed in FIGS. 1 and 2, but a different inner diaphragm 90. In this embodiment, the inner diaphragm 90 consists of a continuous, one-piece structure including a tapered outer section 92 integrally formed with a inner section 94 having a generally semi-circular cross sectional shape. A protrusion 96 is formed at the juncture of the outer section 92 and inner section 94 with a substantially vertically-extending wall 98 and a horizontally extending base 100. Preferably, the wall 98 is affixed by adhesive directly to the outer wall 37 of the former 34 of the voice coil 32 so that the inner section 94 of the lower diaphragm 90 overlies the former 34. This construction also adds significant stiffness to overall two-piece diaphragm construction.

In addition to the enhanced stiffness of the diaphragms provided by each of the embodiments described above, it is noted that a seal is created between the upper and lower diaphragms 40, 42 of FIGS. 1 and 2, and between the upper and lower diaphragms 40 and 90 of FIG. 3, along the entire area therebetween including the area above the voice coil 32. The air captured between the diaphragms 40, 42 and 40, 90 is therefore not subject to pressurization and de-pressurization imposed by forces resulting from the movement of the air within the enclosure for the loudspeaker 10. As described above, such forces can operate to tend to collapse or separate two-piece diaphragm constructions, of the type found in the prior art. Instead, in the embodiments of this invention, the air between the diaphragms 40, 42 and 40, 90 resists such forces and assists in maintaining the integrity and connection between the diaphragms 40, 42 and 40, 90.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure including a voice coil having a former with a hollow interior defining an inner surface, and an outer surface which mounts a wire winding;

a frame having an upper end and a lower end, said lower end being connected to said motor structure;

a lower suspension connected between said frame and said voice coil;

an upper suspension connected to said upper end of said frame;

an upper diaphragm connected to said upper suspension;

a one-piece lower diaphragm having an outer section connected to said upper suspension and an inner section which overlies said hollow interior of said former of said voice coil, said inner and outer sections forming a continuous structure extending from said upper suspension and being connected to said voice coil at the juncture of said inner and outer sections.

2. The loudspeaker of claim 1 in which said inner section is connected to said upper diaphragm.

3. The loudspeaker of claim 1 in which said inner section is formed in the shape of a truncated cone.

4. The loudspeaker of claim 3 in which said inner section has a tapered sidewall connected to generally planar top wall which collectively form the shape of a truncated cone, said top wall being connected to said upper diaphragm.

5. The loudspeaker of claim 1 in which said inner section is generally semi-circular in cross-section, and is spaced from said upper diaphragm.

6. The loudspeaker of claim 1 in which said upper suspension has an outer edge connected to said upper end of said frame and an inner edge formed with an upper surface and a lower surface, said upper diaphragm being connected to said upper surface of said inner edge and said upper suspension and said lower diaphragm being connected to said lower surface of said inner edge of said upper suspension.

7. A loudspeaker comprising:

a motor structure including a voice coil having a former with a hollow interior defining an inner surface and an outer surface which mounts a wire winding;

a frame having an upper end and a lower end, said lower end being connected to said motor structure;

a lower suspension connected between said frame and said voice coil;

an upper suspension connected to said upper end of said frame;

an upper diaphragm connected to said upper suspension;

a sleeve connected to said outer surface of said former of said voice coil, said sleeve being formed with an adhesive well;

a one-piece lower diaphragm having an outer section connected to said upper suspension and an inner section which overlies said hollow interior of said former of said voice coil, said inner and outer sections forming a continuous structure having a protrusion at the juncture thereof, said protrusion being mounted within said adhesive well of said sleeve to connect said lower diaphragm to said voice coil.

8. The loudspeaker of claim 7 in which said inner section is connected to said upper diaphragm.

9. The loudspeaker of claim 7 in which said inner section is formed in the shape of a truncated cone.

10. The loudspeaker of claim 9 in which said inner section has a tapered sidewall connected to generally planar top wall which collectively form the shape of a truncated cone, said top wall being connected to said upper diaphragm.

11. The loudspeaker of claim 7 in which said upper suspension has an outer edge connected to said upper end of said frame and an inner edge formed with an upper surface and a lower surface, said upper diaphragm being connected to said upper surface of said inner edge and said upper suspension and said lower diaphragm being connected to said lower surface of said inner edge of said upper suspension.

12. A loudspeaker, comprising:

a motor structure including a voice coil having a former with a hollow interior defining an inner surface, and an outer surface which mounts a wire winding;

a frame having an upper end and a lower end, said lower end being connected to said motor structure;

a lower suspension connected between said frame and said voice coil;

an upper suspension connected to said upper end of said frame;

an upper diaphragm connected to said upper suspension;

a one-piece lower diaphragm having an outer section connected to said upper suspension and an inner section, said inner and outer sections forming a continuous structure having a protrusion at the juncture thereof, said protrusion being mounted to said outer surface of said former of said voice coil so that said inner section of said lower diaphragm overlies said hollow interior of said former of said voice coil and said inner section is spaced from said outer diaphragm.

13. The loudspeaker of claim 12 in which said inner section of said lower diaphragm has a generally semi-circular shaped cross-section.

14. The loudspeaker of claim 12 in which said protrusion formed at the juncture of said inner and outer sections of said lower diaphragm has a vertically extending wall which mounts to said outer surface of said former of said voice coil.

15. The loudspeaker of claim 12 in which said upper suspension has an outer edge connected to said upper end of said frame and an inner edge formed with an upper surface and a lower surface, said upper diaphragm being connected to said upper surface of said inner edge and said upper suspension and said lower diaphragm being connected to said lower surface of said inner edge of said upper suspension.

* * * * *